United States Patent [19]

Mursch et al.

[11] Patent Number: 4,890,856

[45] Date of Patent: Jan. 2, 1990

[54] GOLF CART

[75] Inventors: Michael Mursch; Karl-Heinz Schwaiger, both of Munich, Fed. Rep. of Germany

[73] Assignee: SMM Sportive Management und Marketing GmbH, Martinsried, Fed. Rep. of Germany

[21] Appl. No.: 157,512

[22] Filed: Feb. 17, 1988

[30] Foreign Application Priority Data

Feb. 18, 1987 [DE] Fed. Rep. of Germany ..... 3705187

[51] Int. Cl.[4] ..... B62B 3/02

[52] U.S. Cl. ..... 280/646; 280/DIG. 6

[58] Field of Search ..... 280/DIG. 6, 645, 646, 280/652, 655, 47.25

[56] References Cited

U.S. PATENT DOCUMENTS

| | | | |
|---|---|---|---|
| 3,043,602 | 4/1962 | Meiklejohn | 280/646 |
| 3,150,881 | 9/1964 | Van Skyeck | 280/646 |
| 3,167,146 | 1/1965 | Rudolph | 280/DIG. 6 X |
| 4,078,594 | 3/1978 | Oeckl | 280/DIG. 6 X |
| 4,396,205 | 2/1983 | Rosen | 280/646 |
| 4,522,299 | 6/1985 | Clark et al. | 280/DIG. 6 |

FOREIGN PATENT DOCUMENTS

| | | | |
|---|---|---|---|
| 8508855 | 6/1985 | Fed. Rep. of Germany . | |
| 941603 | 11/1963 | United Kingdom | 280/DIG. 6 |
| 1228970 | 4/1971 | United Kingdom | 280/DIG. 6 |
| 1284919 | 8/1972 | United Kingdom . | |

*Primary Examiner*—David M. Mitchell
*Assistant Examiner*—Michael Mar
*Attorney, Agent, or Firm*—Flynn, Thiel, Boutell & Tanis

[57] ABSTRACT

A golf cart has an undercarriage for receiving a bag, a foldable center pole hinged to the undercarriage, and two legs which can be swung in toward the bag and are hinged to the undercarriage, the legs moving apart downwardly in swung-out position and carrying running wheels which are parallel both in swung-out and swung-in position. The wheels, in the swung-in position, laterally flank the bag and have their bottoms flush with the base of the bag, the wheels projecting beyond the front side of the bag, the center pole being located at the front of the bag.

9 Claims, 5 Drawing Sheets

GOLF CART

FIELD OF THE INVENTION

The invention relates to a golf cart.

BACKGROUND OF THE INVENTION

Such a golf cart is known for example from German GM No. 85 08 855. The undercarriage is thereby constructed as a crossbeam to which can be fastened a golf bag with a belt. Thus the golf bag must be removed during folding up of the cart, after which the wheels can be swung laterally against the undercarriage. The wheels project in the swung-in position beyond the undercarriage. In order for the wheels to have, both in the position in which they are swung against the undercarriage, and also in the swung-out working position of the cart, a parallel running direction, the legs are constructed as parallel guide rods, namely of two bars. It is disadvantageous in the known golf cart that it is relatively long in folded condition due to the wheels which project at the bottom end. Also handling leaves much to be desired. Besides having to remove the golf bag prior to folding of the cart, the cart can, in folded condition, only be laid down or leaned against something, when it is not held.

Furthermore, U.S. Pat. No. 4,396,205 discloses a golf cart, in which the legs and the wheels can be recessed into an opening in the center of the front side of a box-shaped bag. A relatively complicated and thus expensive multi-part system is needed for this. Furthermore, this known golf cart can only be carried when the wheels are swung in. It has been tried to overcome this disadvantage with small suitcase rollers. The rolling behavior of such small rollers is, however, very poor.

The purpose of the invention is to create a golf cart, which has good looks and is relatively simple in construction, which even in folded nonworking position can be handled easily, namely which in particular in the nonworking position is distinguished by great compactness and can in nonworking position be pulled and also set down comfortably in an upstanding condition.

This is achieved inventively providing a golf cart with an undercarriage for receiving a bag, a foldable center pole hinged to the undercarriage, two legs which can be swung in and are hinged to the undercarriage, said legs moving apart downwardly in swung-out position and carrying parallel running wheels both in swung-out and also in swung-in position, wherein in the swung-in position the wheels are located laterally of the bag and with their lower ends flush with or above the base of the bag and project beyond the front side of the bag where the center pole is located. Advantageous further developments of the inventive golf cart are characterized in the subclaims.

Since the legs of the inventive golf cart are hinged to the undercarriage such that the wheels, in the nonworking position, end preferably flush with the base of the bag and at any rate do not project downwardly beyond the base, the bag base can be utilized as a reliable support base, namely the golf cart can be left standing up thereon without any problems (i.e. without tipping over). Since on the other hand the wheels, in the nonworking position, project beyond the front side of the base, the cart can, when it is tipped forwardly, be rolled along on its own wheels. Since the wheels are relatively large, they also have a correspondingly good rolling behavior.

The wheels rest thereby, in the nonworking position, laterally on the outside against the bag. Thus the bag has, compared with its length, a relatively small width and thus the cart has a well proportioned, becoming appearance. The legs can thus be designed relatively simply as parallel guide rods formed by two straight bars.

The legs extend, in the swung-in position, preferably in the center area along the front side of the bag in order to be covered by the center pole (which for this purpose is made plate-shaped) in the nonworking position. The straight simply designed bars of the parallel guide rod need then only be provided with an angular wheel carrier, which grips laterally around the bag.

BRIEF DESCRIPTION OF THE DRAWINGS

One embodiment of the inventive golf cart will be described in greater detail hereinafter in connection with the drawings, in which.

DETAILED DESCRIPTION

Figure 1:
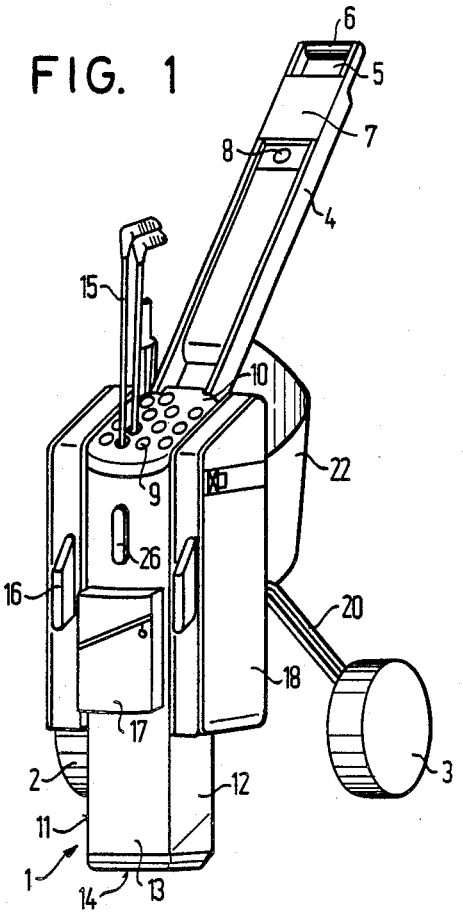
FIGS. 1 and 2 are perspective illustrations of the golf cart in the working position and in the nonworking position respectively.

In FIG. 1, which shows the working position of the golf cart, the golf cart has a square-shaped center bag (container) 1, swung-out wheels 2, 3 and an unfolded center pole 4 with an end recess 5 closed by a handle 6. A scoreboard 7 and a receiving means 8 for a sun umbrella is also provided on the center pole 4.

The container 1 is closed off at its upper end by a plate 10 provided with holes 9, which plate 10 is inclined from the front side, where the center pole 4 is located, toward the back. The container 1 is closed at the bottom by a base 14 and has sidewalls 11 and 12 and a back wall 13 upstanding perpendicularly from the base.

Golf clubs 15 are placed into the holes 9 of the plate 10, which golf clubs depend toward the base 14.

The golf cart furthermore has pockets 16, 17, which are secured releasably on the sidewalls 11, 12 and the back wall 13 on the bag 1, for example by belts, clips or Velcro locks.

The golf cart has wheels 2, 3 which are carried by legs 19, 20. FIG. 1 shows only the leg 20 of the front wheel 3. The legs 19, 20 in FIG. 1 are swung outwardly in the working position and thus extend downwardly and are inclined apart.

Figure 2:
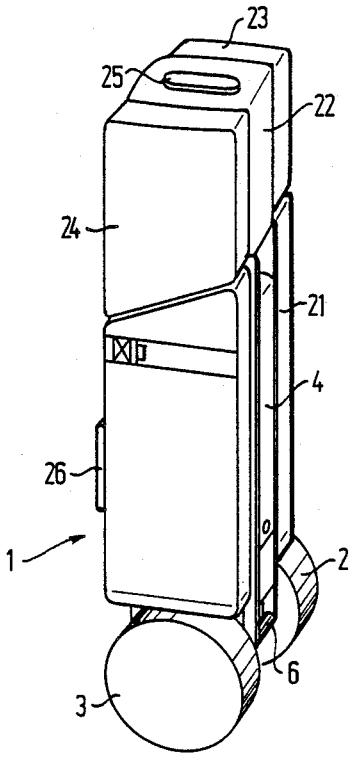

The center pole 4 in the nonworking position of the golf cart, which position is illustrated in FIG. 2, is folded against the front wall 21 of the bag 1 and the wheels 2, 3 are swung against the two sidewalls 11, 12. Furthermore, a cover 22 is arranged on the upper side of the bag 1. Further pockets 23 and 24 are secured releasably on both sides of said cover 22.

It is noticeable that the golf cart is constructed in a very compact or space-saving manner in the nonworking position illustrated in FIG. 2, and thus can be transported for example in the trunk of a car. Handles 25, 26 each are provided on the upper side of the cover 22 and in the center of the back wall 13 of the bag 1 for lifting the golf cart in the nonworking position. Furthermore, the base 14 has recessed handles 27, 28, which are shown in FIG. 3.

The wide plate-shaped center pole 4 is used, for example during transport in the trunk of a car, as a strong defined support surface. It forms at the same time a landing skid (sliding surface) together with the wheels 2, 3 projecting beyond the front wall 21.

Since the wheels 2, 3 have their bottoms flush with the base 14 of the bag 1, the golf cart sits upright in a stable manner, resting securely on the bag base 14, in the nonworking position illustrated in FIG. 2. To move the golf cart from this position, it only needs to be tipped forwardly, which causes the wheels 2, 3 to come into contact with the ground. The golf cart can then be easily pulled on its wheels 2, 3 by the handle 25 on the cover 22. It is thus necessary that the wheels 2, 3 in both the working and nonworking position (FIGS. 1 and 2) run substantially parallel to one another, and thus that the rotation axes 31 of both wheels 2, 3 are in alignment with one another (are arranged coaxially), for example as shown for the nonworking position in FIG. 4.

Figure 3:
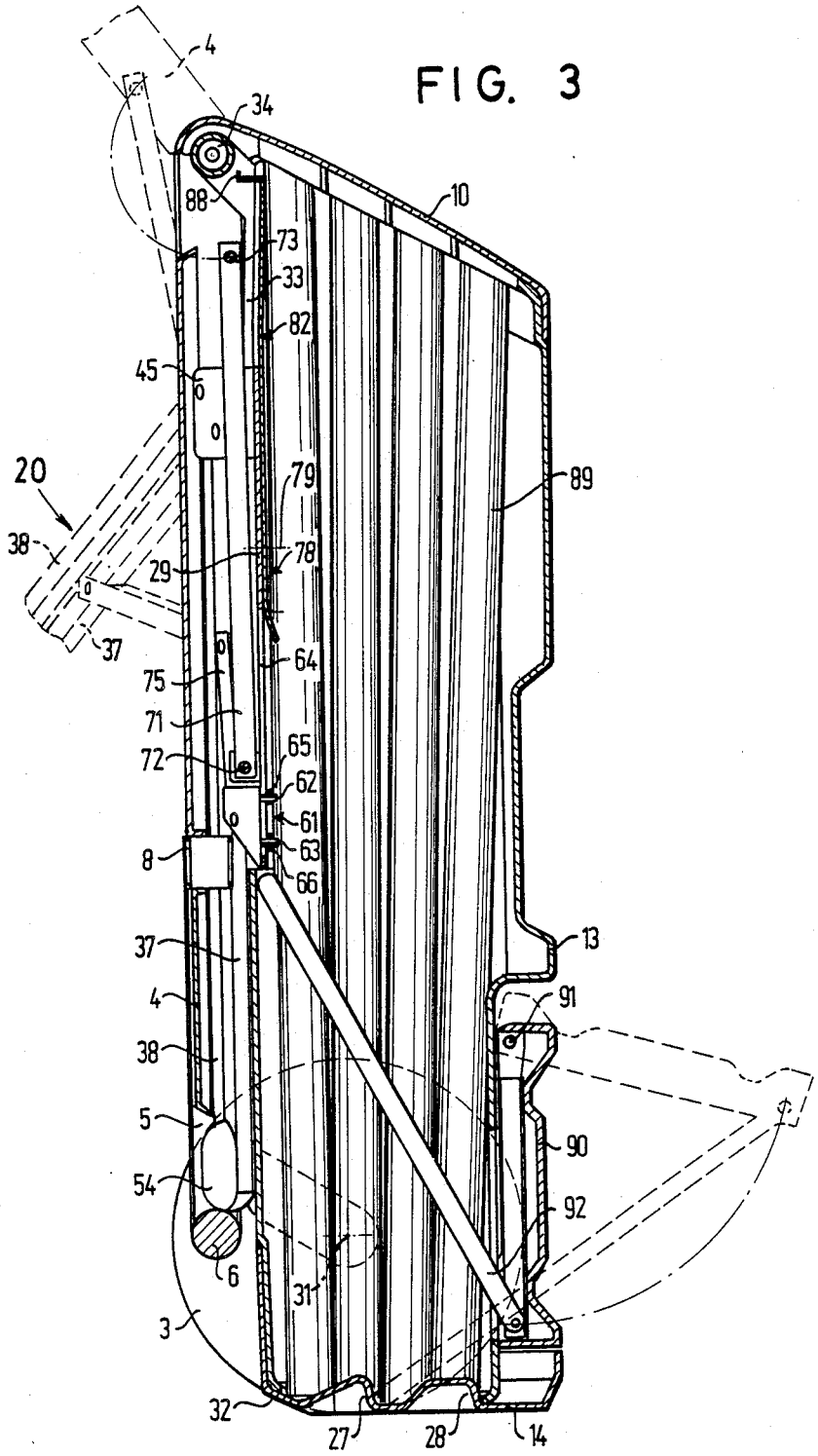
FIG. 3 is a central side cross-sectional view of the golf cart in the nonworking position.
Figure 4:
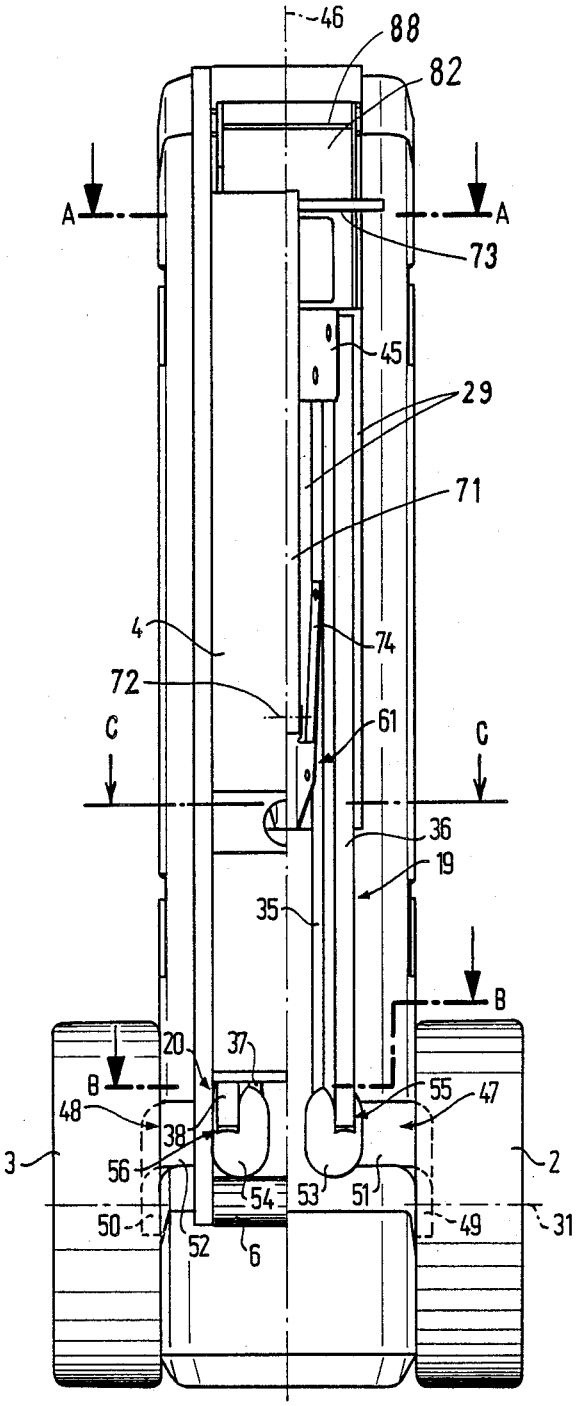
FIG. 4 is a front view of the golf cart in the nonworking position.
Figure 5:
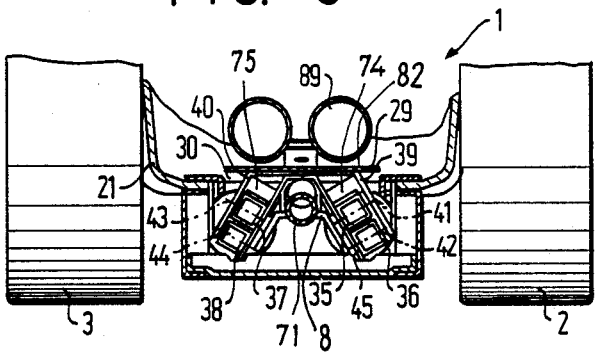
FIGS. 5 and 6 are cross-sectional views respectively taken along the line A—A and B—B of FIG. 4.

According to FIGS. 3 to 5, the bag 1 is fixed on an undercarriage 29. The undercarriage 29 is, as can particularly be seen in FIG. 5, located in an opening 30 in the front wall 21 of the bag 1 and is fixed to said bag 1 by any convenient means.

A handle carrier 33, on which the center pole 4 is secured pivotally about the horizontal axis 34, is secured in the same manner on the bag 1.

The legs 19, 20 are hinged to the undercarriage 29. The legs 19 and 20 respectively comprise two bars 35, 36 and 37, 38 (FIGS. 4 to 6) arranged as parallel guide rods and here made of square section tubing.

The two bars 35, 36 and 37, 38 of legs 19 and 20 are hinged to axes 41, 42 and 43, 44 (FIG. 5) whose outer ends are carried on center flanks 39, 40 of the undercarriage 29, which flanks 39, 40 extend V-shaped (as seen from above) to one another. A part 45 is also V-shaped, is fixed on the undercarriage 29, is arranged between the flanks 39, 40, and supports the axes 41, 42 and 43, 44 at their inner ends.

The undercarriage 29 is provided relatively far up and, referred to its width, in the center of the front wall 21 of the bag. This causes the bars 35, 36 to assume in the working position, which is indicated by dashed lines in FIG. 3, a relatively small angle of 45° or less with respect to the longitudinal axis 46 (FIG. 4) of the bag.

Figure 6:
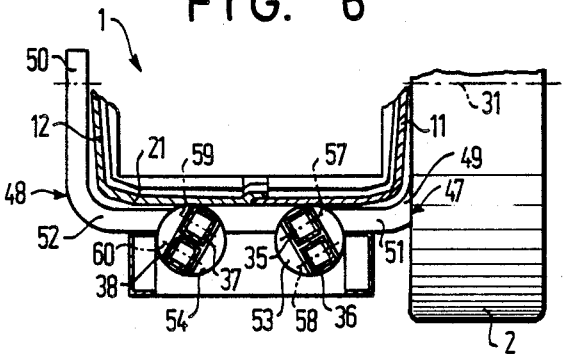

The two bars 35, 36 and 37, 38 of the legs 19 and 20 are provided at the bottom with respective wheel carriers 47 and 48, which can be seen particularly in FIGS. 4 and 6. The wheel carriers 47, 48 are angular (generally L-shaped) and snugly grip around the sidewalls 11, 12 of the bag 1 in the nonworking position.

The wheel carriers 47 and 48 have for this purpose respective legs 49 and 50, which carry the respective wheels 2 and 3 and are located against the sidewall 11 or 12 in the nonworking position, and respective legs 51 and 52, to which the legs 19 and 20 are respectively hinged and which are located against the front wall 21 of the bag 1 in the nonworking position.

The wheel carriers 47 and 48 have respective head-shaped thickened portions 53 and 54 fixed on the inboard ends of the legs 51 and 52 and pivotally engaging the bottom (FIG. 4) ends of the respective bar pairs 35, 36 and 37, 38. In particular, the thickened portions have respective recesses 55 and 56, through which respective pairs of axes 57, 58 and 59, 60 extend, on which axes the respective bars 35, 36 and 37, 38 are pivotally secured The axes 57, 58 and 59, 60 of the bars 35, 36 and 37, 38 (FIG. 6) extend parallel to the associated axes 41, 42 and 43, 44 on the undercarriage 29 at the other end of the respective bars 35, 36 and 37, 38 (FIG. 5). The bar pairs 35, 36 and 37, 38 thus each define a parallelogram linkage for mounting the respective wheels 2 and 3 on the undercarriage 29.

Aside from the head-shaped thickened portions 53, 54, the wheel carriers 47, 48 are of constant thickness.

The bars 35, 36 and 37, 38 in the nonworking position lie closely together in the center of the front wall 21 of the bag 1 and extend parallel to the longitudinal axis 46 of the bag from the undercarriage 29 downwardly to the head-shaped thickened area 53, 54 of the wheel carriers 47, 48. The bars 35, 36 and 36, 37 including the head-shaped thickened area 53, 54 are in this manner completely covered in the nonworking position by the wide, plate-shaped center pole 4.

The lateral legs 49, 50 of the two angular wheel carriers 47, 48, as can be seen from FIGS. 3 and 4, in the nonworking position slope downwardly from the legs 51, 52 on the front wall 21 to the axes of the wheels 2, 3. This gives the head-shaped thickened portions 53, 54 (and the center pole 4 covering said thickening portions) a sufficient distance above the ground, when the cart is being pulled in its tilted nonworking position. In order that the base 14 does not hit the ground in this tilted position, the bag 1 has furthermore between front wall 21 and base 14 a bevelled or sloped area (FIG. 3).

In order for the center pole 4 to be able to rest as closely as possible on the bars 35, 36 and 37, 38 in the nonworking position, the recess 5 of the handle 6 is utilized to receive the thickened areas 53, 54, as seen in FIG. 4. The center pole 4 thus has furthermore a well maneuverable length, in contrast to a longer center pole as it would be needed in the case of longer bars 35, 36 and 37, 38, namely in the case of legs extending horizontally and not inclined downwardly.

The legs 19, 20 swing out as a result of the center pole 4 being moved from the nonworking position shown in FIGS. 2 to 6 into the working position shown in FIG. 1, and swing in when the center pole 4 is being folded against the bag 1.

For this purpose, a slide member 61 is provided on the undercarriage 29. This can be seen particularly in FIGS. 3 and 7. The slide member 61 has two studs 62, 63, which project through a slotted hole 64 upstanding in the center of the undercarriage 29, which slotted hole 64 extends parallel to the longitudinal axis 46 of the bag. The studs 62, 63 are kept in the slotted hole 64, for example by snap rings 65, 66 (FIG. 3) engaged in grooves in the studs 62, 63.

Figure 7:
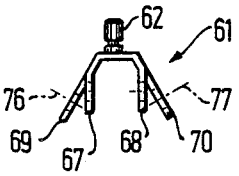
FIG. 7 is a top view of a slide member of the golf cart.
Figure 9:
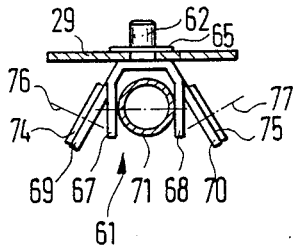
FIG. 9 is a cross-sectional view taken along the line C—C of FIG. 4.
Figure 10:
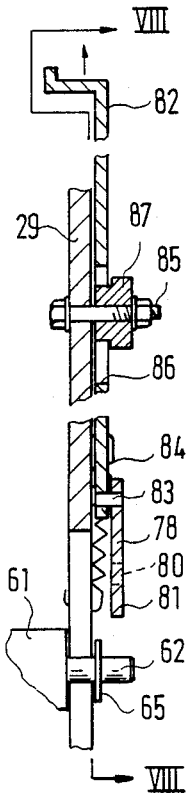
FIG. 10 is an enlarged fragment of FIG. 3 showing the locking pawl of FIG. 8.

The slide member 61 has, as can be seen in FIG. 7, two parallel legs 67, 68, which are perpendicular to the front wall 21 of the bag, and two legs 69, 70, which are arranged V-shaped with respect to one another.

A hinged tie-bar 71 (FIGS. 3 and 4) is secured rotatably on the parallel legs 67, 68 of the slide member 61, the other end of which tie-bar 71 is hinged to the center pole 4 at a point spaced from the center pole's axis of rotation 34. The axes of rotation 72, 73, about which the tie-bar 71 is hinged rotatably on the slide member 61 and center pole 4 respectively, extend horizontally and parallel to the front wall 21 of the bag 1. The tie-bar 71 is here a circular cross-section tube, as seen in FIG. 5.

Support bars 74, 75 (FIG. 3) are respectively hinged at the lower end thereof to the legs 69, 70 of the slide member 61, which legs extend V-shaped with respect to one another. Said support bars 74, 75 are respectively hinged at the upper end thereof on the bars 35, 37 at points spaced above the axes of rotation 41, 42, and 43, 44, to which the bars 35, 36 and 37, 38 are hinged on the undercarriage 29. The axes 41 and 42, about which the bars 35, 37 are rotatable on the undercarriage 29, and the axes 76, 77, about which the bars 35, 37 are rotatable on the slide member 61, are parallel to one another.

The support bars 74, 75 are used for stabilizing the legs 19, 20 in the working position (in the swung-out state) especially since the legs 19, 20 are relatively long and extend at a relatively acute angle of 45° or less (preferably approximately 40°) with respect to the longitudinal axis 46 of the bag, as mentioned above.

The center pole 4 in its extended (unfolded) position indicated in dashed lines in FIG. 3 is arranged at an angle of 150° or less (preferably approximately 120°) with respect to the longitudinal axis 46 of the bag. This angle on the one hand corresponds with the ergonomy during pulling of the cart, and on the other hand a larger angle leads only to a relatively small shifting of the slide member 61 in the slotted hole 64.

Figure 8:
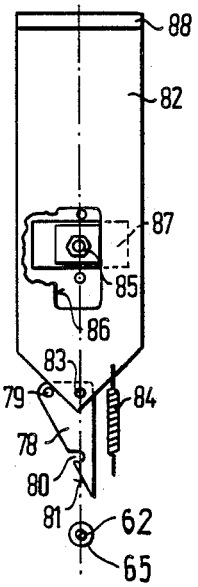
FIG. 8 is an elevational view of a locking pawl and locking-pawl operating mechanism of the golf cart.

To lock the center pole 4 and thus the legs 19, 20 in extended (swung-out) position (thus in the working position of the cart as seen in FIG. 1) a locking pawl 78 is mounted pivotally about an axis 79 fixed on the undercarriage 29 above the slotted hole 64. This can be seen in FIGS. 3 and 8.

The locking pawl 78 is provided with a laterally opening recess 80 near its lower end, below the axis of rotation 79, which axis of rotation 79 is located near the upper end of the slotted hole 64.

During extending (folding out) of the center pole 4, thus slide member 61 is moved up to the upper end of the slotted hole 64 by means of the hinged tie-bar 71. The upper guide stud 62 on the upward moving slide member 61 is thus moved up against a downward and leftward facing (FIG. 8) sloped edge 81 of the locking pawl 78. The rising guide stud 62 thus cams the locking pawl counter-clockwise about the axis of rotation 79, sufficient to enable the stud 62 to enter the left facing recess 80. By reason of a spring 84 and a pawl operating part 82 hereafter described, the locking pawl 78 is urged resliently back clockwise and thus traps the stud 62 in the recess 80. This locks the slide member 61 against dropping downward away from the axis 79 fixed on the undercarriage 29 (and hence on the bag 1), and thus locks the center pole handle 6 and wheels 2, 3 in their folded-out (working) position shown in FIG. 1.

The plate-shaped pawl-operating part 82 is located above the locking pawl 78 and is hinged at 83 to the locking pawl 78 spaced at a mount thereon spaced rightwardly (FIG. 8) from the axis of rotation 79. The operating part 82 is vertically slideably mounted on the undercarriage for movement in a direction parallel to the longitudinal axis 46 of the bag. The spring 84 has one end fixed on the operating part 82 and its other end fixed on the undercarriage 29, to urge the locking pawl 78 into its locking position.

To unlock the locking pawl 78, one pulls up handle 88 (FIGS. 3 and 8) to counter-clockwise pivot the locking pawl 78 enough to release the stud 62 (of the slide member 61) from recess 80 in the locking pawl. This permits slide member 61 to slide downward along the slotted hold 64 in the undercarraige 29. As the slide member 61 slides downward, the support bars 74, 75 and tie bars 71, 72 fold in the centerpost 4 (with handle 6) and wheels 2 and 3 from their working position to their nonworking position of FIG. 2.

A bolt 85 is fixed on the undercarraige 29 to vertically slideably guide the operating part 82, which bolt 85 extends through a longitudinal recess 86 in the operating part 82 and holds the operating part 82 vertically slideably against the undercarraige 29 with a sliding bearing member 87.

A handle 88 is provided at the upper end of the operating part 82, which handle 88 is arranged below the axis of rotation 34 of the center pole 4 and above the W-shaped part 31 on the undercarraige 29 and is therefore easily accessible when the center pole 4 is extended (folded out).

FIGS. 3 and 5 show that a tube extends in the bag 1 from each hole 9 in the plate 10 to the base 14. The tubes 89 are slightly inclined, so that they converge downwardly. The lower ends of the tubes 89 are fixed to the recessed handles 27, 28 in the bottom of the base.

FIG. 3 shows that the golf cart has furthermore an integrated folding seat 90. The folding seat 90 is for this purpose pivoted at its upper edge about a horizontal axis 91 in a recess on the back wall 13 in the lower half of the bag 1.

A support rod 92 is hinged to the free (bottom or rightward in FIG. 3) end of the folding seat 90, namely the end remote from the pivot axis 91. In its position illustrated in full lines in FIG. 3, with the seat 90 folded up (stored), said support rod 92 extends between the tubes 89 and is inclined upwardly toward the front wall 21 of the bag 1.

In its position illustrated by dashed lines in FIG. 3, with the seat 90 opened up, the support rod 92 is supported on the inwardly arched handle 27.

In place of the illustrated support rod 92, the seat 90 can also be supported by a rod (not shown), which is hinged on the lower end of the bag 1 and engages a receiving means (not shown) at the free edge of the seat 90, which edge is remote from the pivot axis 91.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A golf cart, comprising:

an undercarriage for receiving a bag;

a center pole hinged to the undercarriage and adapted to fold down against the front of the bag into a stored position and capable of being swung forward and up into a working position;

two legs which are hinged to the undercarriage and can be swung in toward the undercarriage, said legs being movable laterally apart and downwardly from a swung-in storage position to a swung-out working position and carrying running wheels, the running wheels being parallel to each other in both the swung-out and swung-in positions, the wheels in the swung-in position closely laterally flanking the bag and having their bottoms flush with or above the base of the bag and projecting beyond the front side of the bag, the center pole in its folded down stored position extending down along the front side of the bag, each leg being constructed as a parallelogram linkage comprising two bars, the legs in their swung-in storage position lying along the center portion of the front side of the bag;

a generally L-shaped wheel carrier provided on the bottom of each leg, each said generally L-shaped wheel carrier having first and second arms joined substantial1y at a right angle to each other, the first arm being pivota11y supported on the lower ends of the two bars of the associated leg and extending laterally outward therefrom, said second arm being fixed to the laterally outboard end of said first arm and extending generally rearward therefrom to a free end on which is rotatably supported the associated wheel, the two generally L-shaped wheel carriers in their swung-in positions wrapping snugly around the front and sides of the bottom portion of the bag, the center pole being plate-shaped and sized to cover the legs when the legs are in their swung-in position against the center portion of the front side of the bag and the center pole is folded down against the front of the bag;

wherein the plate-shaped center pole is provided at its free end with an end recess closed by a handle to form a hand opening for pulling the cart in said workirg position, each L-shaped wheel carrier having a respective lead-shaped thickened portion fixed thereon where it pivotally engages the bottom ends of the corresponding two bars of the corresponding leg, each thickened portion having a respective recess therein pivotally receiving the bottom ends of the corresponding two bars of the corresponding leg, the two bars being pivotally secured to the corresponding thickened portion on a pair of axes which pair of axes pass through the corresponding recess in the corresponding thickened portion of the corresponding wheel carrier, the thickened portions of the wheel carriers being received in said hand opening of the center pole with the legs ard center pole in their storage position folded against the front of the bag.

2. A golf cart according to claim 1 wherein the second arm of each generally L-shaped wheel carrier is inclined downwardly and rearwardly in the swung-in storage position of the legs.

3. A golf cart according to claim 1, including means interconnecting said legs and center pole for swinging in the legs to their storage position during folding of the center pole against the front of the bag.

4. A golf cart according to claim 3, wherein the means for swinging-in comprises a slide member slidably guided on the undercarriage, a tie-bar hinged at one end on said slide member and secured rotatably at it other end on the center pole, and two support bars hinged at one end on said slide member and secured rotatably at their other end on the legs.

5. A golf cart according to claim 4, wherein the slide member is guided in a slotted hole in the undercarriage.

6. A golf cart according to claim 4, including a locking pawl for locking the center pole in its upward and forward swung position, said locking pawl having a recess, said locking pawl being secured swingably on the undercarriage and being spring-loaded in its locking position, and a locking bolt secured on the slide member, said locking bolt being engageable in said locking pawl recess to keep said center pole in its upward and forward swing.

7. A golf cart according to claim 6, wherein the locking pawl has a sloped edge for engaging the locking bolt.

8. A golf cart according to claim 6, including an operating part guided movably on the undercarriage and hinged to the locking pawl for unlocking said locking pawl.

9. A golf cart according to claim 1, including a seat located on the back side of the bag, which seat is folded up against said bag.

* * * * *

UNITED STATES PATENT AND TRADEMARK OFFICE

CERTIFICATE OF CORRECTION

PATENT NO. : 4 890 856

DATED : January 2, 1990

INVENTOR(S) : Michael MURSCH et al.

It is certified that error appears in the above-identified patent and that said Letters Patent is hereby corrected as shown below:

Col. 7, line 16; change "substantially at" to ---substantially at---.

Col. 7, line 17; change "being pivotally" to ---being pivotally---.

Col. 7, line 34; change "workirg position" to ---working position---.

Col. 7, line 35; change "respective lead-shaped" to ---respective head-shaped---.

Col. 8, line 5; change "legs ard center" to ---legs and center---.

Col. 8, line 18; change "at it" to ---at its---.

Signed and Sealed this

Fourth Day of December, 1990

*Attest:*

HARRY F. MANBECK, JR.

*Attesting Officer*

*Commissioner of Patents and Trademarks*